US011404791B2

(12) United States Patent
Yun et al.

(10) Patent No.: US 11,404,791 B2
(45) Date of Patent: Aug. 2, 2022

(54) CYLINDRICAL ANTENNA ASSEMBLY

(71) Applicant: TE CONNECTIVITY CORPORATION, Berwyn, PA (US)

(72) Inventors: Xing Yun, Harrisburg, PA (US); Nathan William Swanger, Dillsburg, PA (US)

(73) Assignee: TE Connectivity Services GmbH

( * ) Notice: Subject to any disclaimer, the term of this patent is extended or adjusted under 35 U.S.C. 154(b) by 410 days.

(21) Appl. No.: 16/544,217

(22) Filed: Aug. 19, 2019

(65) Prior Publication Data

US 2021/0057825 A1 Feb. 25, 2021

(51) Int. Cl.

| | |
|---|---|
| ***H01Q 11/08*** | (2006.01) |
| ***H01Q 3/24*** | (2006.01) |
| ***H01Q 21/00*** | (2006.01) |
| ***H01Q 1/36*** | (2006.01) |

(52) U.S. Cl.

CPC ..... *H01Q 11/08* (2013.01); *H01Q 1/362* (2013.01); *H01Q 3/24* (2013.01); *H01Q 21/0006* (2013.01)

(58) Field of Classification Search

CPC ..... H01Q 1/38; H01Q 1/36; H01Q 1/1207; H01Q 1/362; H01Q 11/08; H01Q 3/24; H01Q 1/50; H01Q 21/0006

See application file for complete search history.

(56) References Cited

U.S. PATENT DOCUMENTS

| | | | | |
|---|---|---|---|---|
| 6,421,029 | B1 * | 7/2002 | Tanabe | H01Q 5/40 343/702 |
| 9,190,718 | B2 | 11/2015 | DiNallo et al. | |
| 2003/0020670 | A1 * | 1/2003 | Noro | H01Q 11/08 343/895 |
| 2008/0174501 | A1 | 7/2008 | Licul et al. | |
| 2011/0254755 | A1 | 10/2011 | DiNallo | |
| 2013/0099999 | A1 * | 4/2013 | Christie | H01Q 1/38 343/895 |
| 2019/0006733 | A1 * | 1/2019 | Yasin | H01Q 11/08 |

* cited by examiner

*Primary Examiner* — Alexander H Taningco
*Assistant Examiner* — Amy X Yang

(57) ABSTRACT

An antenna assembly includes an antenna carrier having a cylindrical body with a side wall extending between a top and a bottom and extensions extending from the side wall at the bottom at different radial positions. An antenna is coupled to the body having a film supporting first and second antenna elements having first and second feed lines and first and second antenna lines. The feed lines extend along corresponding extensions and the antenna lines wrap helically around the side wall. The antenna assembly includes clip terminals coupled to the extensions being electrically coupled to corresponding feed lines. The clip terminals have terminating ends configured to be electrically terminated to host conductors.

16 Claims, 4 Drawing Sheets

CYLINDRICAL ANTENNA ASSEMBLY

BACKGROUND OF THE INVENTION

The subject matter herein relates generally to antenna assemblies.

Antenna assemblies are used in many applications, including automotive applications. For example, antenna assemblies may be used for Bluetooth conductivity, Wi-Fi conductivity or other types of wireless communication within a vehicle. There is a need for compact multiband antennas that provide controlled radiation patterns with uniform antenna coverage. Some known antenna assemblies utilize a helix antenna having four antenna elements arranged in a helical antenna pattern to provide a compact multiband antenna having controlled radiation patterns with uniform antenna coverage. However, conventional helix antennas are not without disadvantages. For instance, connecting the four antenna elements to the feed points is quite challenging and typically requires additional components, such as crimped terminals, to connect the antenna feeds to a separated circuit board and to then use the separated circuit board to connect the antenna to a host circuit board through insert pins or a cable. The multiple components add cost to the antenna due to the additional parts and the additional assembly time. Additionally, the multiple components add bulk and size to the antenna assembly.

A need remains for a reliable and cost effective antenna assembly.

BRIEF DESCRIPTION OF THE INVENTION

In one embodiment, an antenna assembly is provided. The antenna assembly includes an antenna carrier having a cylindrical body. The cylindrical body has a side wall that extends between a top and a bottom. The antenna carrier has a first extension extending from the side wall at the bottom at a first radial position and a second extension extending from the side wall at the bottom at a second radial position. An antenna is coupled to the body of the antenna carrier. The antenna has a film supporting a first antenna element and a second antenna element. The first antenna element has a first feed line and a first antenna line extending from the first feed line. The first feed line extends along the first extension. The first antenna element wraps helically around the side wall. The second antenna element has a second feed line and a second antenna line extending from the second feed line. The second feed line extends along the second extension. The second antenna line wraps helically around the side wall. The antenna assembly includes a first clip terminal coupled to the first extension and is electrically coupled to the first feed line. The first clip terminal has a first terminating end that is configured to be electrically terminated to a first host conductor. A second clip terminal is coupled to the second extension and is electrically coupled to the second feed line. The second clip terminal has a second terminating end that is configured to be electrically terminated to a second host conductor.

In another embodiment, an antenna assembly is provided. The antenna assembly includes an antenna carrier having a cylindrical body. The cylindrical body has a side wall that extends between a top and a bottom. An antenna is coupled to the body of the antenna carrier. The antenna has a film supporting a first antenna element and a second antenna element. The film has a top and a bottom. The film has a first edge and a second edge extending between the top and the bottom. The film has a first feed tab extending from the bottom. The film has a second feed tab extending from the bottom at a spaced apart location from the first feed tab. The first antenna element has a first feed line and a first antenna line. The first feed line extends along the first feed tab. The first antenna element extends from the first feed line non-orthogonal to the bottom. The second antenna element has a second feed line and a second antenna line. The second feed line extends along the second feed tab. The second antenna line extends from the second feed line non-orthogonal to the bottom. The antenna is coupled to the side wall such that the top and the bottom of the antenna extend parallel to the top and the bottom of the antenna carrier. The first and second antenna elements wrap helically around the antenna carrier.

In a further embodiment, an antenna assembly is provided. The antenna assembly includes an antenna carrier that has a cylindrical body. The cylindrical body has a side wall extending between a top and a bottom. The side wall forms a cavity in the body. An antenna is coupled to the body of the antenna carrier. The antenna has a film supporting a first antenna element and a second antenna element. The first antenna element has a first feed line and a first antenna line extending from the first feed line. The first antenna element wraps helically around the side wall. The second antenna element has a second feed line and a second antenna line extending from the second feed line. The second antenna line wraps helically around the side wall. The antenna assembly includes a dielectric insert removably received in the cavity. The first and second antenna lines wrap helically around the dielectric insert.

DETAILED DESCRIPTION OF THE INVENTION

Figure 1:
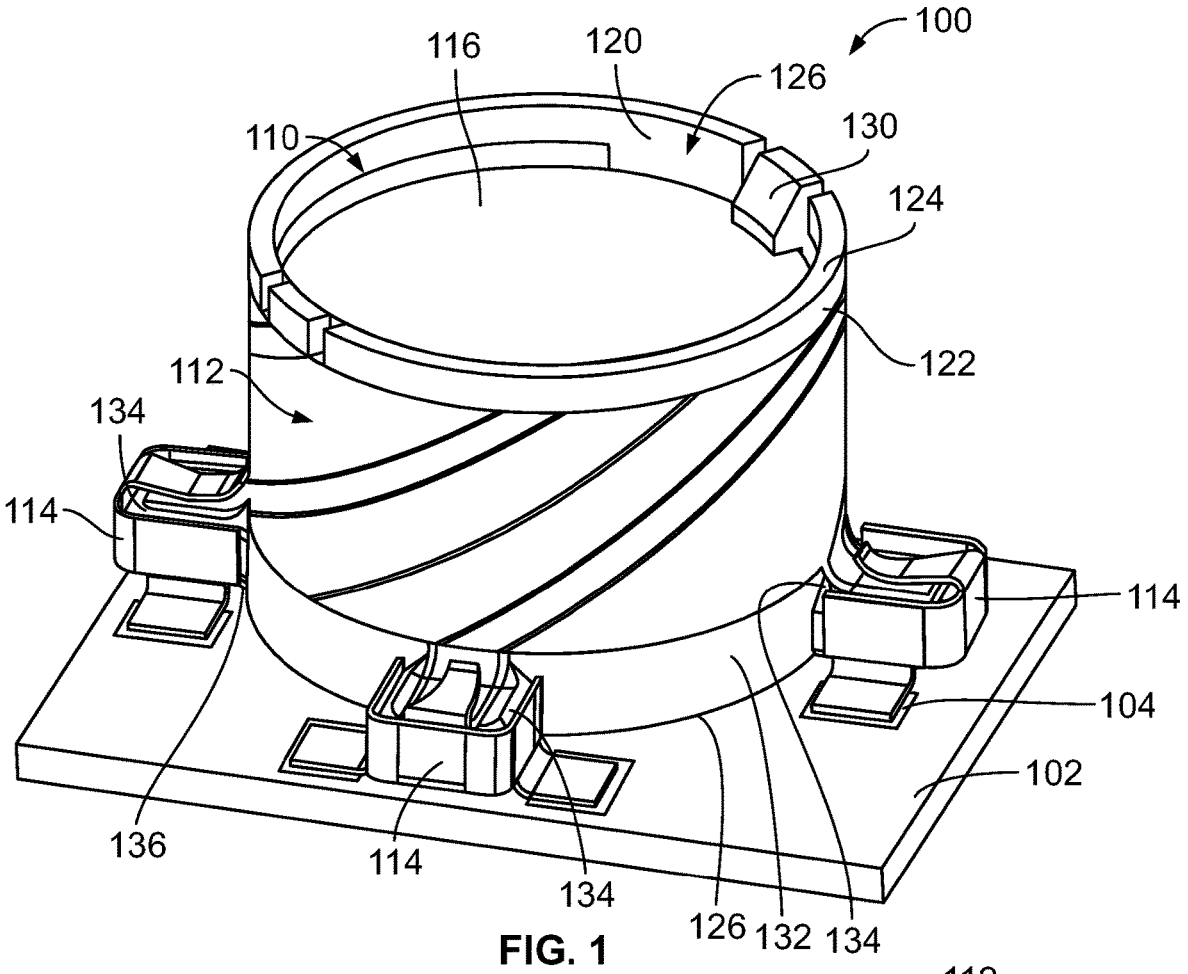
FIG. 1 illustrates an antenna assembly in accordance with an exemplary embodiment.

FIG. 1 illustrates an antenna assembly 100 in accordance with an exemplary embodiment mounted to a host component, such as a host circuit board 102. The antenna assembly 100 is electrically connected to host conductors 104 of the host circuit board 102. In the illustrated embodiment, the host conductors 104 are circuits of the host circuit board 102, such as pads, traces, vias, and the like. The antenna assembly 100 may be soldered to the host conductors 104 in various embodiments. The antenna assembly 100 may be terminated to the host conductors 104 by other means in alternative embodiments, such as being press-fit in plated vias of the host circuit board 102 using compliant pins. In other various embodiments, the host component may include one or more cables and the antenna assembly 100 may be terminated to the cables, such as being soldered to the cables or terminated to contacts are terminals at ends of the cables. In an exemplary embodiment, the antenna assembly 100 is configured to be directly electrically connected to the host component (for example, the host circuit board 102), without the need for multiple intervening components, such as an interstitial circuit board between the antenna assembly and the host circuit board 102. The antenna assembly 100 is configured to be assembled in a cost effective and reliable manner by directly connecting to the host circuit board 102.

The antenna assembly 100 includes an antenna carrier 110, an antenna 112 coupled to the antenna carrier 110, and clip terminals 114 coupled to the antenna carrier 110 and the antenna 112. The antenna 112 is wrapped around the outside of the antenna carrier 110. The antenna carrier 110 defines the shape of the antenna 112, which, in the illustrated embodiment, forms a cylindrical antenna. In an exemplary embodiment, the antenna 112 is a helix antenna having antenna elements 160 (shown in FIG. 2), such as four antenna elements 160, wrapped around the antenna carrier 110 in a helical antenna pattern to provide a compact multiband antenna having a controlled radiation pattern with uniform antenna coverage. The antenna elements 160 are spaced at 0°, 90°, 180° and 270° in an exemplary embodiment. Optionally, the antenna elements 160 may be ¼ wavelength antenna elements.

The clip terminals 114 electrically connect the antenna 112 to the host conductors 104. The clip terminals 114 may be used to mechanically coupled the antenna carrier 110 to the host circuit board 102. The clip terminals 114 are stamped and formed parts configured to be removably coupled to the antenna carrier 110 and the antenna 112. For example, the clip terminals 114 may be clipped onto and removed from the antenna carrier 110 and the antenna 112, such as during assembly. In an exemplary embodiment, the clip terminals 114 form a non-permanent electrical connection with the antenna 112 such that the clip terminals 114 do not damage the antenna 112 during assembly and/or disassembly.

In an exemplary embodiment, the antenna assembly 100 includes a dielectric insert 116 removably coupled to the antenna carrier 110. The dielectric insert 116 includes a dielectric body manufactured from a dielectric material having a high dielectric constant. In an exemplary embodiment, the material of the dielectric body is selected to tune the antenna 112 at one or more desired frequencies. The size and shape of the dielectric insert 116 may be selected to tune the antenna 112 at one or more desired frequencies. The dielectric insert 116 is removable, such as to replace the dielectric insert 116 with a different dielectric insert 116 having different characteristics, such as being manufactured from a different dielectric material to tune the antenna 112 at one or more different desired frequencies.

The antenna carrier 110 includes a cylindrical body 120 having a side wall 122 extending between a top 124 and a bottom 126. In an exemplary embodiment, the side wall 122 defines a cavity 128 that receives the dielectric insert 116. The cavity 128 may be open at the top 124 and/or the bottom 126, such as for receiving the dielectric insert 116. In an exemplary embodiment, the side wall 122 includes retention features 130 for securing the dielectric insert 116 in the cavity 128. In the illustrated embodiment, the retention features 130 are deflectable latches. However, other types of retention features 130 may be used in alternative embodiments, such as fasteners, a lid, a hot melt cover, and the like.

The side wall 122 of the body 120 includes an exterior 132. The antenna 112 is coupled to the exterior 132 of the body 120. In an exemplary embodiment, the antenna carrier 110 includes one or more extensions 134 extending from the side wall 122. In various embodiments, the extensions 134 may be provided at the bottom 126. For example, bottoms 136 of the extensions 134 may be generally co-planer with the bottom 126 or the bottoms 136 may extend below the bottom 126, defining mounting feet, for supporting the antenna carrier 110 on the host circuit board 102. In the illustrated embodiment, the antenna carrier 110 includes discrete extensions 134 extending radially outward from the side wall 122 at different radial positions. The number of extensions 134 may correspond to the number of antenna elements 160 of the antenna 112, as described in further detail below. In various embodiments, the extensions 134 may be spaced equidistant from each other, such as at 90° radial positions from each other. The extensions 134 form feet providing mounting locations for the clip terminals 114. In other various embodiments, the antenna carrier 110 may include a single extension 134 in the form of a circumferential flange extending entirely circumferentially around the side wall 122.

Figure 2:
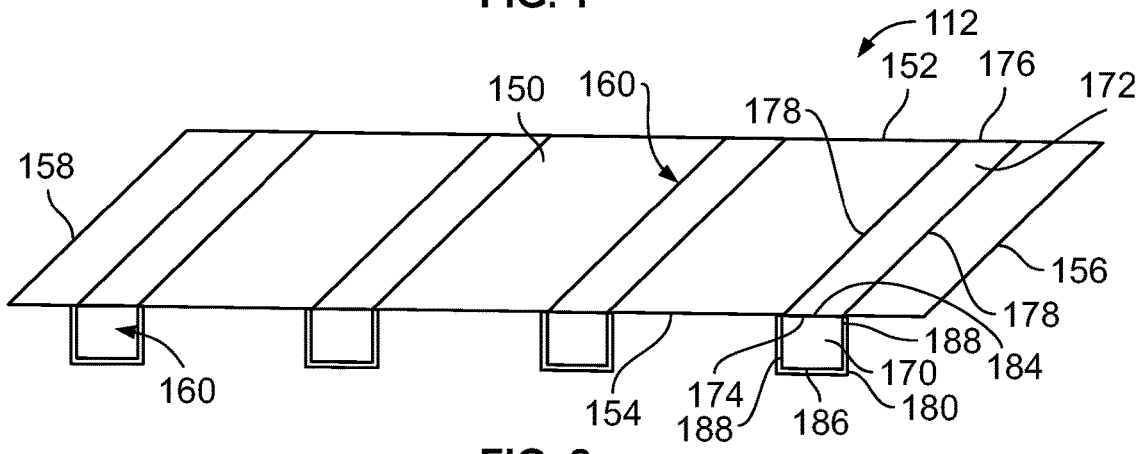
FIG. 2 is a plan view of the antenna in a flattened state in accordance with an exemplary embodiment.
Figure 3:
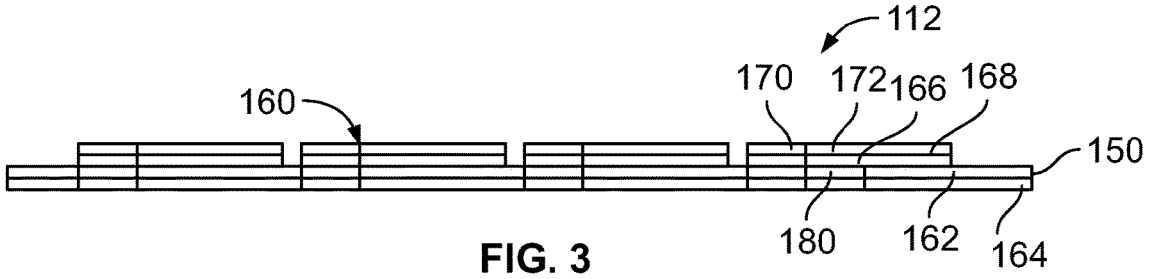
FIG. 3 is an elevational view of the antenna in a flattened state in accordance with an exemplary embodiment.

FIG. 2 is a plan view of the antenna 112 in a flattened state, such as during manufacture, prior to coupling to the antenna carrier 110 (shown in FIG. 1) in accordance with an exemplary embodiment. FIG. 3 is an elevational view of the antenna 112 (not shown to scale) in a flattened state in accordance with an exemplary embodiment. The antenna 112 includes a film 150 supporting antenna elements 160.

The film 150 includes a top 152 and a bottom 154. The film 150 includes a first edge 156 extending between the top 152 and the bottom 154 and a second edge 158 extending between the top 152 and the bottom 154. Optionally, when the film 150 is wrapped around the antenna carrier 110, the first and second edges 156, 158 may face each other. For example, the first and second edges 156, 158 may abut against each other or nearly abut against each other. The first edge 156 may overlap the second edge 158 when the film 150 is wrapped around the antenna carrier 110, or vice versa. In an exemplary embodiment, the top 152 and the bottom 154 are parallel to each other. In an exemplary embodiment, the first edge 156 and/or the second edge 158 is nonorthogonal to the top 152 and/or the bottom 154. For example, the first edge 156 and the second edge 158 may be angled at a transverse angle to the top 152 and the bottom 154 such that the first edge 156 and the second edge 158 is non-perpendicular to the top 152 and non-perpendicular to the bottom 154. Optionally, the first edge 156 may be parallel to the second edge 158. For example, the film 150 may be parallelogram-shaped. Other shapes are possible in alternative embodiments.

In various embodiments, the antenna 112 is a flexible printed circuit. In other various embodiments, the antenna 112 is a flexible flat cable. The film 150 includes a flexible plastic substrate, such as manufactured from polyimide, PEEK, polyester, or other plastic material. The antenna elements 160 may be metal traces, such as copper traces, silver traces or other metal traces. The antenna elements 160 may be formed by a subtractive process or an additive process. The antenna 112 may be manufactured by laminating various layers to form the antenna 112. Optionally, the antenna elements 160 may be provided on a single side of the film 150, such as the outer side of the film 150. Alternatively, the antenna elements 160 may be provided on both sides of the film 150.

In an exemplary embodiment, with reference to FIG. 3, the antenna 112 includes a film layer 162, an adhesive layer 164 on an interior of the film layer 162, an adhesive layer 166 on an exterior of the film layer 162, and a circuit layer 168 on the adhesive layer 166. The antenna 112 may include additional or different layers in alternative embodiments. The adhesive layer 164 is used to secure the film 150 to the antenna carrier 110 (shown in FIG. 1). The adhesive layer 166 is used to secure the circuit layer 168 on the film layer 162. The film layer 162 defines the film 150 and the circuit layer 168 defines the antenna elements 160.

Each antenna element 160 includes a feed line 170 and an antenna line 172 extending from the feed line 170. The feed line 170 is configured to be coupled to the clip terminal 114 (shown in FIG. 1) to form the feed point of the antenna element 160. The antenna line 172 forms the main resonating structure of the antenna element 160. In an exemplary embodiment, the antenna line 172 is longer than the feed line 170. In an exemplary embodiment, the antenna line 172 is angled relative to the feed line 170 such that the antenna line 172 is nonparallel to the feed line 170. For example, the antenna line 172 extends at a transverse angle relative to the feed line 170.

In an exemplary embodiment, the antenna line 172 includes a feed end 174 at the feed line 170 and a distal end 176 opposite the feed end 174. The antenna line 172 includes sides 178 extending between the feed end 174 and the distal end 176. Optionally, the sides 178 may be parallel to each other such that the antenna line 172 has a constant thickness between the feed end 174 and the distal end 176. Alternatively, the sides 178 may be nonparallel to each other such that the antenna line 172 has a variable thickness. Optionally, the sides 178 may be parallel to the first edge 156 and/or the second edge 158. The antenna line 172 is provided on the film 150. In an exemplary embodiment, the antenna line 172 extends entirely across the film 150 between the top 152 and the bottom 154. For example, the feed end 174 is provided at the bottom 154 and the distal end 176 is provided at the top 152. In alternative embodiments, the antenna line 172 extends only partially across the film 150.

In an exemplary embodiment, the antenna 112 includes feed tabs 180 extending from the bottom 154 of the film 150. The feed tabs 180 are spaced apart from each other, such as at regular intervals. The feed tabs 180 support corresponding feed lines 170. Optionally, the feed tabs 180 and the feed lines 170 may extend radially outward from the bottom 154, such as perpendicular to the bottom 154. However, the feed tabs 180 and/or the feed lines 170 may extend at transverse angles from the bottom 154 in alternative embodiments. In an exemplary embodiment, the feed tabs 180 are formed integral with the film 150 (for example, as a unitary and monolithic structure with the film 150). Optionally, the feed tabs 180 may be bent relative to the film 150, such as out of the plane defined by the film 150.

In an exemplary embodiment, the feed line 170 includes an antenna end 184 at the feed end 174 of the antenna line 172 and a distal end 186 opposite the antenna end 184. The feed line 170 includes sides 188 extending between the antenna end 184 and the distal end 186. Optionally, the sides 188 may be parallel to each other. Alternatively, the sides 188 may be nonparallel to each other such that the feed line 170 has a variable thickness. Optionally, the sides 188 may be parallel to the sides of the feed tab 180.

Figure 4:
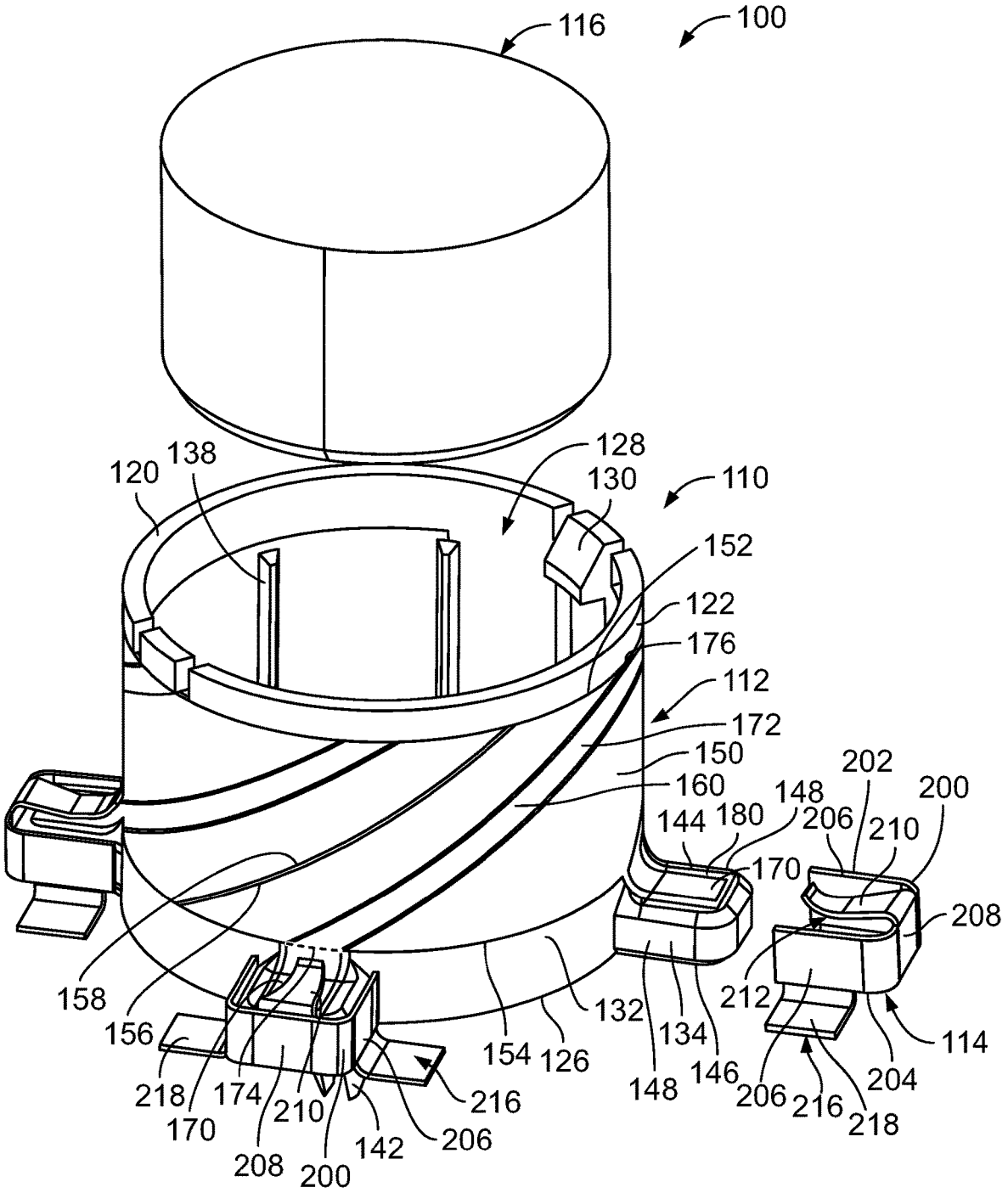
FIG. 4 is a top perspective, exploded view of the antenna assembly in accordance with an exemplary embodiment.
Figure 5:
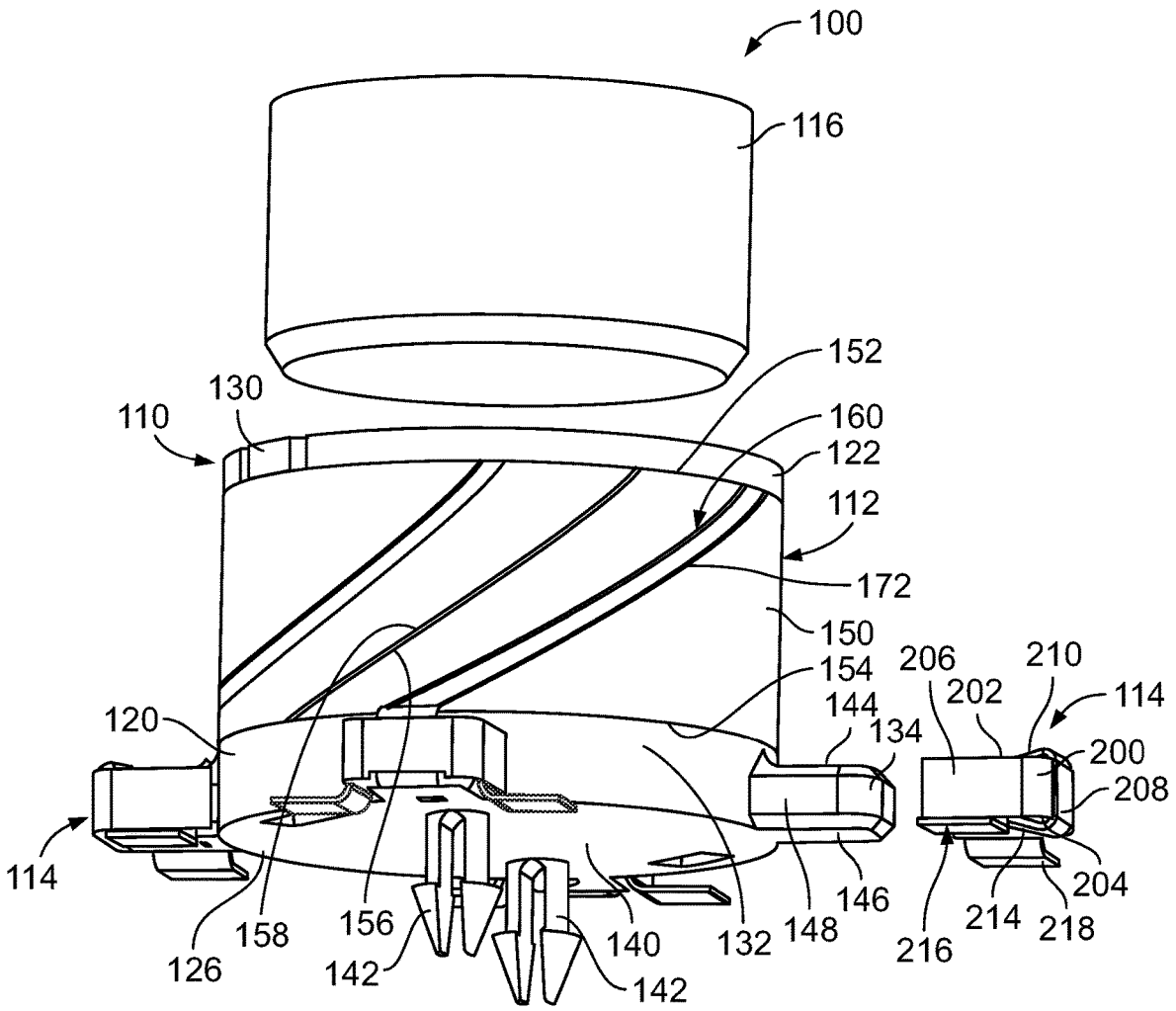
FIG. 5 is a bottom perspective, exploded view of the antenna assembly in accordance with an exemplary embodiment.

FIG. 4 is a top perspective, exploded view of the antenna assembly 100 in accordance with an exemplary embodiment. FIG. 5 is a bottom perspective, exploded view of the antenna assembly 100 in accordance with an exemplary embodiment. The dielectric insert 116 is shown poised for loading into the antenna carrier 110. The antenna 112 is shown coupled to the antenna carrier 110. Two of the clip terminals 114 are shown coupled to the antenna carrier 110 and one of the clip terminals 114 is shown poised for coupling to the antenna carrier 110 and the antenna 112.

During assembly, the dielectric insert 116 is loaded into the cavity 128 of the antenna carrier 110. Optionally, the body 120 may include positioning ribs 138 extending into the cavity 128 to position the dielectric insert 116 in the cavity 128. The positioning ribs 138 may be crush ribs that may be deformed when the dielectric insert 116 is loaded in the cavity 128. The retention features 130 are used to secure the dielectric insert 116 in the cavity 128. Optionally, the retention features 130 may allow removal and insertion of the dielectric insert 116 from and into the cavity 128, such as for replacement or use of a different type of dielectric insert 116 (for example, to change the antenna characteristics). In an exemplary embodiment, the body 120 includes a bottom wall 140 (FIG. 5) at the bottom 126 to close the cavity 128 and retain the dielectric insert 116 in the cavity 128. Optionally, mounting posts 142 (FIG. 5) extend from the bottom wall 140 for mounting the body 120 to the host circuit board 102 (shown in FIG. 1). The mounting posts 142 may include compliant beams for securing the mounting posts 142 to the host circuit board 102. Other types of mounting features may be used for securing the antenna carrier 110 to the host circuit board 102, such as using threaded fasteners or other types of securing features. The mounting posts 142 provide strain relief for the connection between the clip terminals 114 and the host circuit board 102. The material and positioning of the dielectric insert 116 relative to the antenna elements 160 affects the antenna characteristics of the antenna elements 160 allowing the antenna 112 to be tuned by selective use of one of various different dielectric inserts 116 (for example, different shaped dielectric inserts 116 and/or dielectric inserts 116 manufactured from different dielectric materials).

The antenna 112 is wrapped around the side wall 122 in a spiral curved shape around the cylinder-shaped exterior 132. The first edge 156 faces the second edge 158 at a seam. The seam is located between corresponding antenna elements 160. The antenna 112 is positioned relative to the antenna carrier 110 such that the feed tabs 180 are aligned with and extend along top surfaces 144 of the extensions 134. For example, the feed tabs 180 are bent perpendicular to the film 150 to extend radially outward from the side wall 122 along the top surfaces 144. The extensions 134 rigidly hold and support the feed lines 170 for connection with the clip terminals 114. The feed lines 170 extend along the feed tabs 180 and are exposed on the feed tabs 180 for electrical connection with the clip terminals 114. The antenna lines 172 extend from the feed lines 170 along the film 150 and wrap helically around the side wall 122. For example, the antenna line 172 extends from the feed end 174 at the feed line 170 at the bottom 154 of the film 150 along a helical path to the distal end 176 at or near the top 152 of the film 150. In various embodiments, the helical paths of the antenna lines 172 may be at least partially overlapping. For example, the distal ends 176 may overlap the adjacent antenna element 160. The antenna 112 may be tuned to one or more designated frequencies, such as by controlling antenna characteristics by controlling thicknesses of the antenna elements 160, lengths of the antenna elements 160, angles of the spiral wrapping of the antenna elements 160, the amount of overlap of the antenna elements 160, spacing between the antenna elements 160, shape of the antenna elements 160, and the like.

During assembly, the clip terminals 114 are coupled to the extensions 134 such that the clip terminals 114 are electrically connected to the antenna elements 160. Each clip terminal 114 includes a stamped and formed body 200 extending between a top 202 and a bottom 204. The clip terminal 114 includes side walls 206 and an end wall 208 extending between the side walls 206. The clip terminal 114 includes a mating beam 210 extending from the top 202 to engage the feed line 170 at a separable mating interface 212. In an exemplary embodiment, the mating beam 210 extends from the end wall 208. However, the mating beam 210 may extend from another portion of the body 200, such as one of the side walls 206. In other various embodiments, the mating beam 210 may be configured to engage the side of the extension rather than the top of the extension 134, such as if the feed tab and the feed line 170 were to extend along the side of the extension 134. In the illustrated embodiment, the mating beam 210 faces the top surface 144 of the extension 134 and is configured to be spring loaded against the feed line 170. The mating beam 210 forms a non-permanent electrical connection with the feed line 170 of the antenna element 160 such that the clip terminal 114 does not damage the antenna element 160 during assembly and/or disassembly.

In an exemplary embodiment, the mating beam 210 is a deflectable spring beam configured to be spring loaded against the feed line 170 at the separable mating interface 212. The mating beam 210 is configured to be clipped onto the extension 134 when the clip terminal 114 is coupled to the antenna carrier 110. Optionally, the clip terminal 114 may include a mating beam 214 extending from the bottom 204 configured to engage a bottom surface 146 of the extension 134. The extension 134 may be clipped or pinched between the mating beams 210, 214. When assembled, the side walls 206 extend along sides 148 of the extension 134 and the side walls 206 may pinch or squeeze against the sides 148 in various embodiments.

In an exemplary embodiment, the clip terminal 114 includes terminating ends 216 for mechanically and electrically connecting the clip terminal 114 directly to the host conductor 104 (shown in FIG. 1) of the host circuit board 102 (shown in FIG. 1), without the need for intervening components, such as other terminals, cables, circuit boards, and the like. In the illustrated embodiment, the terminating ends 216 include solder tabs 218. The solder tabs 218 are configured to be surface mounted to the host circuit board 102, such as by a reflow solder process. In the illustrated embodiment, the solder tabs 218 extend from the side walls 206 at the bottom 204. The end wall 208 may additionally or alternatively include the solder tab 218 in alternative embodiments. Other types of terminating ends 216 may be provided in alternative embodiments, such as compliant pins, solder tails, and the like.

Figure 6:
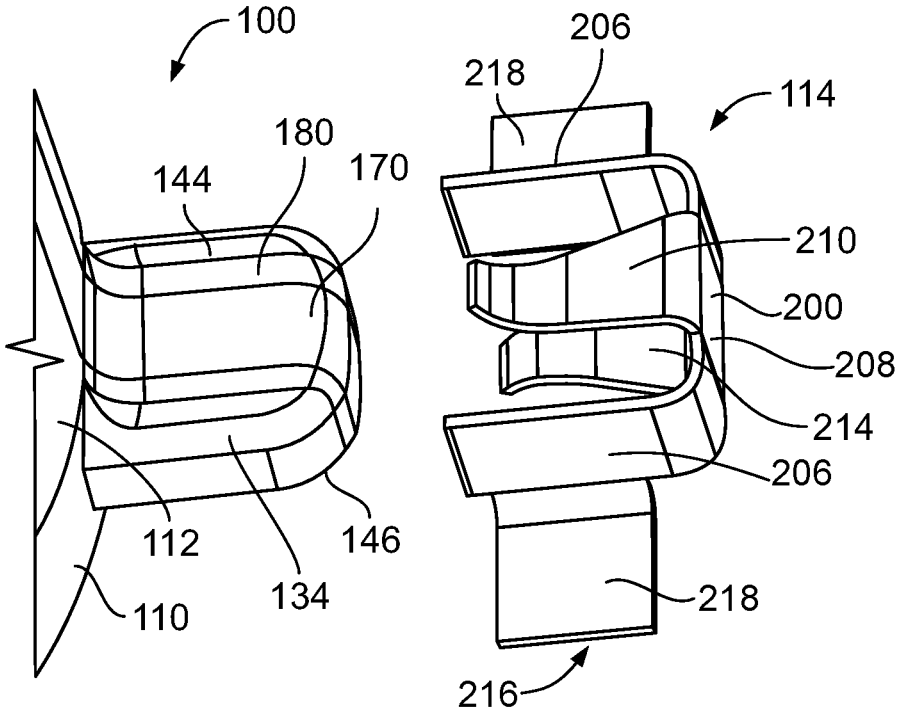
FIG. 6 is a top perspective, exploded view of a portion of the antenna assembly in accordance with an exemplary embodiment.
Figure 7:
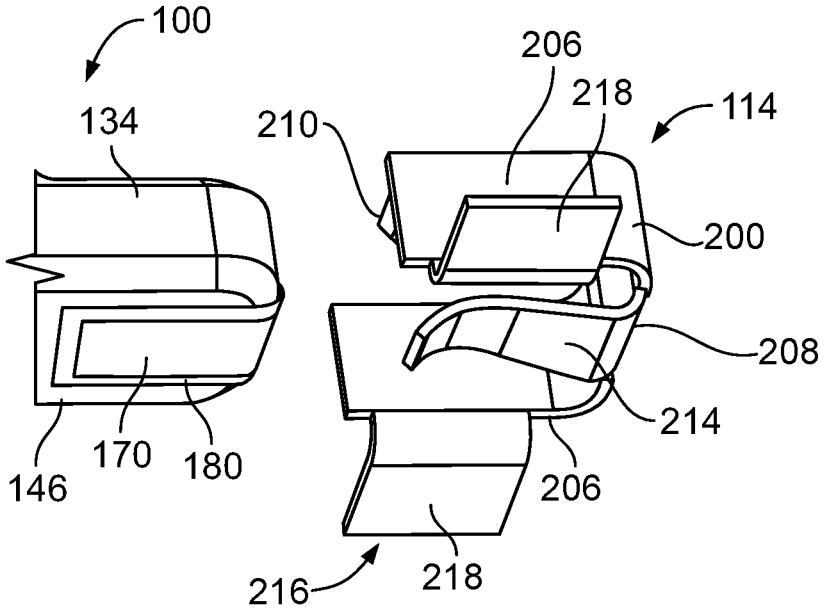
FIG. 7 is a bottom perspective, exploded view of a portion of the antenna assembly in accordance with an exemplary embodiment.

FIG. 6 is a top perspective, exploded view of a portion of the antenna assembly 100 showing the clip terminal 114 poised for coupling to the antenna carrier 110 and the antenna 112 in accordance with an exemplary embodiment. FIG. 7 is a bottom perspective, exploded view of a portion of the antenna assembly 100 showing the clip terminal 114 poised for coupling to the antenna carrier 110 and the antenna 112 in accordance with an exemplary embodiment.

The clip terminal 114 includes the body 200 extending between the top 202 and the bottom 204. The clip terminal 114 includes the side walls 206 and the end wall 208 extending between the side walls 206. The clip terminal 114 includes the upper and lower mating beams 210, 214. The clip terminal 114 includes the solder tabs 218 at the terminating ends 216.

In the illustrated embodiment, the feed tab 180 and the feed line 170 is elongated to wrap around the extension 134 from the top surface 144 to the bottom surface 146. The clip terminal 114 is coupled to the extension 134 and the feed line 170 such that the upper mating beam 210 electrically connects to the feed line 170 along the top surface 144 and the mating beam 214 electrically connects to the feed line 170 along the bottom surface 146.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An antenna assembly comprising:

an antenna carrier having a cylindrical body having a side wall extending between a top and a bottom, the antenna carrier having a first extension extending from the side wall at the bottom at a first radial position and a second extension extending from the side wall at the bottom at a second radial position;

an antenna coupled to the body of the antenna carrier, the antenna having a film supporting a first antenna element and a second antenna element, the first antenna element having a first feed line and a first antenna line extending from the first feed line, the first feed line extending along the first extension, the first antenna element wrapping helically around the side wall, the second antenna element having a second feed line and a second antenna line extending from the second feed line, the second feed line extending along the second extension, the second antenna line wrapping helically around the side wall;

a first clip terminal coupled to the first extension being electrically coupled to the first feed line, the first clip terminal having a first terminating end configured to be electrically terminated to a first host conductor; and a second clip terminal coupled to the second extension being electrically coupled to the second feed line, the second clip terminal having a second terminating end configured to be electrically terminated to a second host conductor.

2. The antenna assembly of claim 1, wherein the first clip terminal is electrically coupled to the first feed line at a first separable mating interface and the second clip terminal is electrically coupled to the second feed line at a second separable mating interface.

3. The antenna assembly of claim 1, wherein the first clip terminal includes a first mating beam spring loaded against the first feed line at a first separable mating interface and the second clip terminal includes a second mating beam spring loaded against the second feed line and a second separable mating interface.

4. The antenna assembly of claim 1, wherein the first terminating end includes a solder tab soldered to the first host conductor and the second terminating end includes a solder tab soldered to the second host conductor.

5. The antenna assembly of claim 1, wherein the first clip terminal includes a stamped and formed body removably coupled to the first extension to electrically couple to the first feed line and the second clip terminal includes a stamped and formed body removably coupled to the second extension to electrically couple to the second feed line.

6. The antenna assembly of claim 1, wherein the first clip terminal includes a first main body extending between a top and a bottom, the first terminating end including a solder tab extending from the bottom, the first clip terminal including a first mating beam extending from the top to mate with the first feed line at a first separable mating interface, and wherein the second clip terminal includes a second main body extending between a top and a bottom, the second terminating end including a solder tab extending from the bottom, the second clip terminal including a second mating beam extending from the top to mate with the second feed line at a second separable mating interface.

7. The antenna assembly of claim 1, wherein the first feed line extends radially outward from the side wall along a top surface of the first extension and the second feed line extends radially outward from the side wall along a top surface of the second extension.

8. The antenna assembly of claim 1, wherein the film includes a first feed tab and a second feed tab spaced apart from the first feed tab, the first feed line extending along the first feed tab, the second feed line extending along the second feed tab.

9. The antenna assembly of claim 1, wherein the film includes a top and a bottom, the film including a first edge and a second edge, the first and second edges being non-orthogonal to the bottom, the first and second feed lines extending from the bottom onto the first and second extensions, respectively.

10. The antenna assembly of claim 9, wherein the first and second edges are wrapped helically around the side wall, the first and second antenna lines extending parallel to the first and second edges.

11. The antenna assembly of claim 1, wherein the second antenna line overlaps the first antenna line at a spaced apart helical path.

12. The antenna assembly of claim 1, wherein the antenna further comprises a third antenna element and a fourth antenna element supported by the film, the third antenna element having a third feed line and a third antenna line extending from the third feed line, the third feed line extending along a third extension of the antenna carrier, the third antenna element wrapping helically around the side wall, the fourth antenna element having a fourth feed line and a fourth antenna line extending from the fourth feed line, the fourth feed line extending along a fourth extension of the antenna carrier, the fourth antenna line wrapping helically around the side wall;

the antenna element further comprising a third clip terminal coupled to the third extension being electrically coupled to the third feed line, the third clip terminal having a third terminating end configured to be electrically terminated to a third host conductor; and the antenna element further comprising a fourth clip terminal coupled to a fourth extension being electrically coupled to the fourth feed line, the fourth clip terminal having a fourth terminating end configured to be electrically terminated to a fourth host conductor.

13. The antenna assembly of claim 1, wherein the film includes a polyimide film layer and an adhesive layer interior of the polyimide film layer for securing the film to the side wall, the first and second antenna elements provided exterior of the polyimide film layer.

14. The antenna assembly of claim 1, wherein the bottom of the antenna carrier is mounted to a host circuit board including the first and second host conductors.

15. The antenna assembly of claim 1, wherein the side wall of the cylindrical body of the antenna carrier defines a cavity configured to receive a dielectric insert, the first and second antenna lines wrapping helically around the dielectric insert.

16. The antenna assembly of claim 1, wherein the first and second clip terminals mechanically and electrically connect the antenna carrier and the antenna to a host circuit board including the first and second host conductors.

* * * * *